US005117775A

United States Patent [19]

Northam et al.

[11] Patent Number: 5,117,775

[45] Date of Patent: Jun. 2, 1992

[54] FLOATATION DEVICE

[76] Inventors: T. Edward Northam; John Borland, both of 355 Airport Drive, Winkler, Manitoba, Canada, R0G 2X0

[21] Appl. No.: 608,363

[22] Filed: Nov. 2, 1990

[51] Int. Cl.[5] ..... B63B 35/44

[52] U.S. Cl. ..... 114/267; 441/129

[58] Field of Search ..... 114/49, 69, 266, 267; 441/1, 129, 130, 131, 133

[56] References Cited

U.S. PATENT DOCUMENTS

| | | | |
|---|---|---|---|
| 2,374,372 | 4/1945 | Moss | 114/69 |
| 3,881,439 | 5/1975 | Svonholm | 114/69 |
| 5,020,175 | 6/1991 | Kirkpatrick et al. | 441/129 |

*Primary Examiner*—Jesûs D. Sotelo

*Attorney, Agent, or Firm*—Adrian D. Battison; Stanley G. Ade; Murray E. Thrift

[57] ABSTRACT

A floation device includes a molded outer shell defining a hollow interior. The hollow interior is filled with recycled plastic bottles of the type used conventionally for soft drink containers which are molded from a plastic material and include a generally cylindrical body and a neck at one end of the body which is closed by a cap. The outer container is shaped with wall portions having a curvature equal to the outside curvature of the bottles and indentations for receiving the necks of the bottles which are aligned neck to neck in rows. The recycled bottles provide a filling for the rotational molded shell which prevent loss of buoyancy if the shell is perforated and prevent expansion and contraction problems due to temperature changes.

10 Claims, 3 Drawing Sheets

FLOATATION DEVICE

FIELD OF THE INVENTION

This invention relates to the field of floatation devices for example for one in supporting floating docks, pontoon boats and the like.

BACKGROUND OF THE INVENTION

At the present time there is available a wide selection of floatation devices. There is along with this wide selection a wide degree of effectiveness as well as a very wide price range. The most commonly used floatation device comprises simply a billet of a closed cell foam material formed for example from polystyrene foam. Devices of this type do provide adequate floatation, but are not environmentally sound, nor easily repaired if damaged. Some such devices are known to waterlog over time and some are susceptible to chemical attack. Also, the cleaning of algae from the surface is quite difficult, if not impossible.

In an alternative arrangement, rotationally molded plastics hollow shells are used. If these are hollow, a simple puncture will cause a total loss of buoyancy and hence this device is not widely accepted. Foam filled shells of this type are environmentally sound, temperature stable, chemical resistant and structurally sound but are very expensive, and cannot economically compete with the foam billet.

SUMMARY OF THE INVENTION

It is an object of the present invention to provide a recycled and recyclable floatation device that will not waterlog and that is resistant to chemical attack, is easily repairable, temperature stable, non-corroding, abrasion resistant and inexpensive.

The present invention provides a floatation device comprising a watertight outer shell thereon, having an opening thereon and defining a substantially closed interior, a sealing member attached over the opening to fully close the outer shell and a plurality of separate, sealed plastic air cell members inserted within the said inner core.

The present invention further provides a floatation device in which the plastic air cells within the inner core are comprised of recycled sealed plastic soft drink containers.

The present invention further provides for a process of manufacture of a floatation device in which the inner core is filled with a plurality of recycled sealed plastic soft drink containers.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
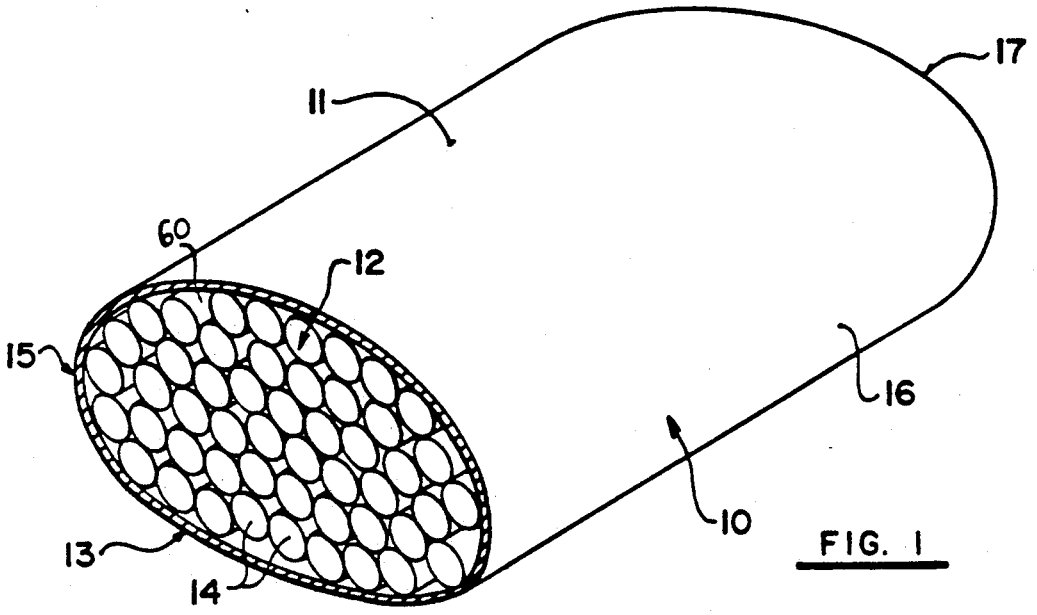
FIG. 1 shows an isometric view partly in cross-sectional of one embodiment of the present invention.
Figure 2:
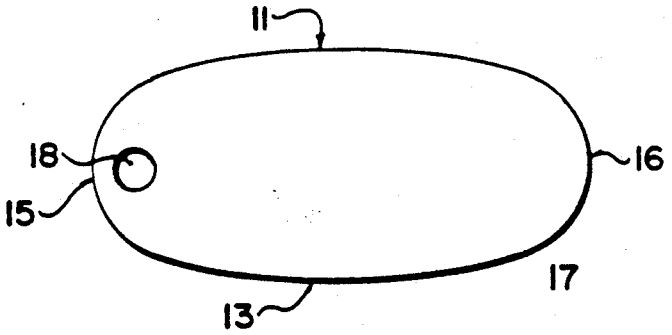
FIG. 2 is an end view of the embodiment of FIG. 1.

A floatation device comprised of a watertight outer shell 10, made of a suitable plastic material. The shell is shaped to follow the shape of a conventional foam billet and includes upper and lower surfaces 11, 13, sides 15, 16 and ends 17. Within the shell is a buoyant core 12 having a plurality of inner cell members 14 therein. There is an opening 18 on the end 17 of the device near one side 15 of the device. The inner cell members 14 are made of plastic and are irregular shaped, which allow them to absorb fluctuations in the internal pressure of the device. The plastic cells in the preferred embodiment described herein are recycled sealed plastic soft drink containers.

Figure 5:
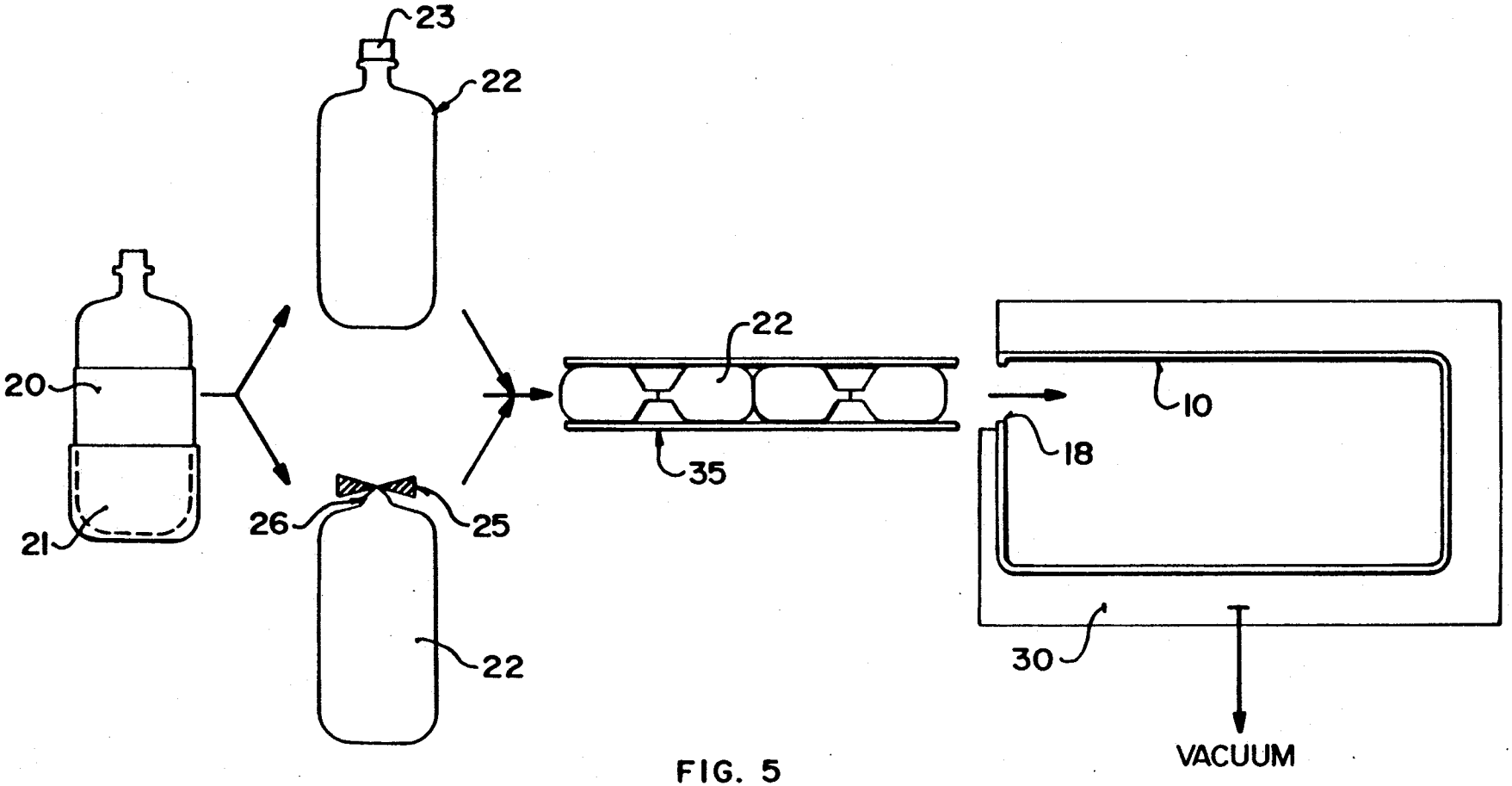
FIG. 5 is a schematic view of a process of manufacture of the floatation device of FIGS. 3 and 4.

As shown in FIG. 5, in a process of manufacture, the label 20 and polyurethane base 21 of the soft drink container 22 is removed and the plastic soft drink containers are cleaned out. The cap 23 is then put back on the container, thus sealing the container and providing a buoyant air filled cell. The containers are sealed at room temperature. The containers may also be sealed under pressure. This is described later.

In an alternative technique, the neck of the container may be snipped or twisted off by a device 25, and resealed by a head seal with the remaining stub 26 stuffed in to the bottle. Whether the neck is removed or not, the container is sealed thus providing a buoyant air filled cell.

In one technique, the sealed unpressurized soft drink containers are then cooled. The bottles partially collapse as a result of this cooling process. This enables one to put a container with a smaller volume into the outer shell 10. The containers 22 are placed into the outer shell through an opening 18 at a cooler temperature. Once the shell is filled, the shell and contents are warmed to room temperature. The increase in temperature results in an expansion of the partially collapsed sealed containers to their original shape. As the containers 14 are of sturdy one-piece construction, there is very little expansion beyond the room temperature size despite increases in temperature in use. As the containers 14 are heated, they expand to form a tight fit within the core 12 of the outer shell 10. The airtight nature of the inner containers 14, along with their strong polyethelene ester composition, allows the inner containers 14 to sustain large fluctuations of temperature and pressure. For the device 10 to loose its buoyancy, numerous cells must be punctured at the same time.

As an alternative to the above procedure, the bottles may be sealed under a small amount of pressure, in the range of 2–4 psi. The bottles easily withstand such a small amount of pressure and as a result of this pressurization, the containers do not collapse in cold weather, but rather maintain their shape, even on a very cold day. Empty soft drink containers can endure a very high pressurization without bursting. A two-liter plastic soft drink container can handle 120 psi without bursting while expanding very little, if at all.

The outer shell 10 is then filled, not at a cooled temperature as above, but at room temperature as the outer surface of the outer shell of the device is placed under vacuum by a device schematically indicated at 30 so that the differential pressure thus applied across the inner and outer surfaces of the shell causes it to expand. As the containers 14 are under pressure they are not affected by the vacuum process in any way.

Applying a vacuum to the outer surface of the float results in the outer shell being expanded to allow loading of the slightly pressurized containers. As the outer shell is expanded, this allows a maximum loading of the bottles into the inner core. As the containers are under pressure, they will not contract in any vacuum created. The containers may be loaded into the core 12 of the of the device in one of two ways. They may be aligned and detachably fastened by using glue, hot melt or other adhesive top to top or top to bottom, and all orderly placed in the float core, parallel with each other. The bottles may also be randomly placed into the core before sealing, as mentioned above.

If using the vacuum method described above, the outer shell is held open by vacuuming outside of the shell. This allows one the option of either randomly filling the device or filling the device in an orderly manner. As the containers are attached top to top or top to bottom, they may be placed in an elongate sleeve 35, which could be made of a material such as polyethelene. The sleeve, with containers 22 therein, is placed into the core of the device, and the sleeve removed to leave the containers in rows aligned parallel with each other.

There may be added to the interior 12 of the device, an interior foam filler 50, that is comprised of a low density material such as polyurethane that maintains or enhances floatation by encapsulating air within its tiny bubbles. This step may be optional on some embodiments of the floatation device as there is often adequate floatation provided by the inner cells 14 without any filler 50.

After the containers 14 and filler 50, if any, are added, the outer shell 10 is sealed under vacuum or high temperature to enclose the inner core. The opening 18 is sealed after use by a spinpatch method so as to permanently attach a patch 38, but it is possible to have within this opening a permanent opening and bung arrangement. As the opening is at the end, if required water or other ballast material is allowed to enter or exit the float when the bung open. If, for example, the dock is removed from the water, the ballast material is easily drained through the opening 18 by removing the bung. If an opening is not desired, a spinpatch method could be used to seal the opening on the outer surface, thereby providing a one-piece durable plastic shell, with no seams or joints.

Figure 3:
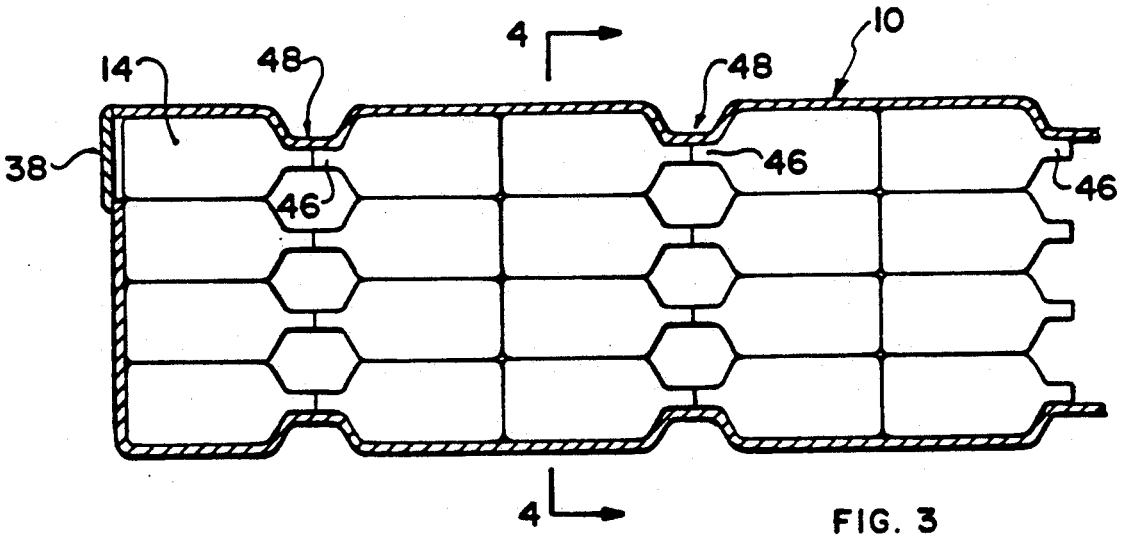
FIG. 3 is a longitudinal cross-sectional view of a second embodiment of the invention.
Figure 4:
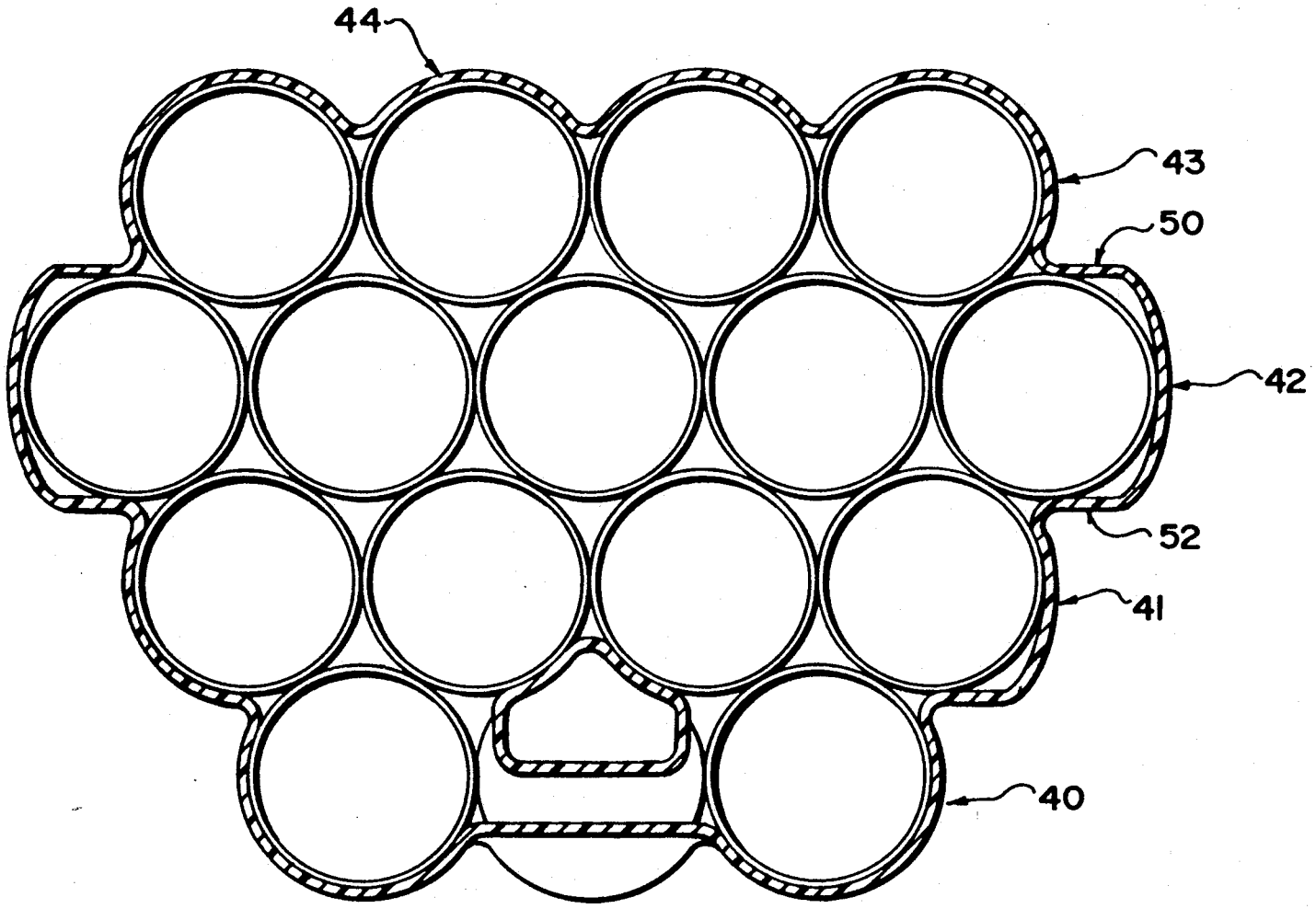
FIG. 4 is a cross-sectional view along the lines 4—4 of FIG. 3.

As shown in FIGS. 3 and 4, the containers can be aligned end to end in rows so that when deposited into the shell they form layers 40, 41, 42, 43 with each layer having a number of rows 44. The layer 40 has 3 rows, the layer 41 has four rows, the layer 42 has five rows and layer 43 has four rows. The containers are aligned end to end with the neck portion 46 of each adjacent to the neck portion of a next adjacent container. The shell 10 has surrounding recesses 48 which act to define an inwardly projecting rib on the inner surface of the shell which engages into the area of the necks 46. This helps to locate the containers and also reduces the amount of free air within the shell relative to contained air.

The degree of floatation is determined by both the air within the bottles and the air in the spaces between the bottles in the core. In one embodiment of the device shown in FIG. 4, the bottles are stacked so that at the end, in cross section, the number of bottles in a row, from bottom to top is four, five, four, three. In the embodiment described, this provides a specific degree of floatation. There is no filler used between the bottles, and should the device leak, and water enter the shell, the degree of floatation is decreased. In this particular situation, by turning the float upside-down, so that the number of bottles per row in cross section, at the end of the device is three, four, five, four, from bottom to top, the degree of freeboard i.e.) the change in distance from the ledge to the top of the deck, is almost unchanged. The distance from ledge 50 to the top of the deck and the distance from ledge 52 to the top of the deck, when there is a hole in the float, and the float is turned upside down, is almost unchanged.

The filler is low cost and, like the inner containers 14, is made from recycled material. The entire device is environmentally safe and it may itself be recycled.

The floatation device 10 is made of a strong durable material that is not susceptible to chemical attack or fluctuation in temperature or pressure. The device is inexpensive when compared to floatation devices comprised of polyurethane filler on the market today. It is easily cleaned, pest proof and rust proof. It is also abrasion and impact resistant.

The device herein has potentially three levels of protection against the loss of buoyancy (1) the outer shell, (2) the inner cells, and (3) the foam fill to bind the cells.

The uses of the device are essentially unlimited where floatation is required. Some potential uses are pontoons, docks, rafts, oil spill booms, pipeline floats, work barges, boat houses and instrument buoys.

Since various modifications can be made in my invention as hereinabove described, and many apparently widely different embodiments of same made within the spirit and scope, it is intended that all matter contained in the accompanying specification shall be interpreted as illustrative only and not in a limiting sense.

We claim:

1. A floatation device comprising a closed outer shell defining therein a hollow interior of the shell, and a plurality of separate, sealed air cell members inserted within the hollow interior, the air cell members comprising sealed recycled plastic bottles, each bottle having a generally cylindrical body, a neck at one end of the body and means sealing the neck, each bottle having a wall molded from a plastics material so that the wall is flexible, the outer shell having a wall formed integrally to include a generally horizontal top portion, a generally horizontal bottom portion, two generally vertical side portions and two generally vertical end portions, the wall being continuous and closed except for at least one opening in at least one of said portions dimensioned to receive therethrough said bottles, said at least one opening being closed by a closure member applied thereover, the top and bottom portions being spaced by said side and end portions by a distance sufficient to receive therebetween a plurality of layers of said bottles, said bottles being arranged in a plurality of parallel layers with each of said layers having therein a plurality of parallel rows of bottles.

2. A floatation device according to claim 1 wherein said at least one opening is defined in one of said end portions.

3. A floatation device according to claim 2 wherein the closure member comprises a patch member engaged over the opening and arranged substantially in the plane of the end portion.

4. A floatation device according to claim 3 wherein the closure member comprises a patch member engaged over the opening and arranged substantially in the plane of the end portion.

5. A floatation device comprising a closed outer shell defining therein a hollow interior, and a plurality of separate, sealed air cell members inserted within the hollow interior, the air cell members comprising sealed recycled plastic bottles, each bottle having a generally cylindrical body, a neck at one end of the body and means sealing the neck, each bottle having a wall molded from a plastics material so that the wall is flexible, the outer shell having a wall formed integrally to include a generally horizontal top portion, a generally horizontal bottom portion, two generally vertical side portions and two generally vertical end portions, the wall being continuous and closed except for at least one opening in at least one of said portions dimensioned to receive therethrough said bottles, said at least one opening being closed by a closure member applied thereover, the top and bottom portions being spaced by said side and end portions by a distance sufficient to receive therebetween a plurality of layers of said bottles, said bottles being arranged in a plurality of parallel layers with each of said layers having therein a plurality of parallel rows of bottles, with the bottles of each row arranged end-to-end and each row extending from one end portion to an opposed end portion, the side portion being shaped to define a plurality of side wall portions, each side wall portion being associated with a respective one of the layers, at lest some of the side wall portions having a radius of curvature substantially equal to a radius of curvature of the cylindrical body of the bottles of an adjacent one of the rows of bottles of the respective layer so that an inside surface of the side wall portion closely conforms to an outside surface of the bottles.

6. A floatation device according to claim 5 wherein said at least one opening is defined in one of said end portions.

7. A floatation device according to claim 5 wherein the bottles of a row adjacent a side wall portion are arranged end to end so that the neck of one bottle lies adjacent the neck of a next bottle and wherein the side wall portion includes a recess therein defining a portion of an inner surface thereof which extends to a position adjacent the necks.

8. A floatation device comprising a closed outer shell defining therein a hollow interior, the outer shell having a wall formed by molding from a plastics material, and a plurality of separate, sealed air cell members inserted within the hollow interior, the air cell members comprising sealed recycled plastic bottles, each bottle having a generally cylindrical body, a neck at one end of the body and means sealing the neck, each bottle having a wall molded from a plastics material so that the wall is flexible, the outer shell being shaped to defining a plurality of wall portions, at least some of the wall portions having a radius of curvature substantially equal to a radius of curvature of the cylindrical body of a bottle so that an inside surface of the wall portion closely conforms to an outside surface of the bottle, wherein the bottles are arranged in parallel layers, each layer having a plurality of parallel rows of bottles, one of the layers having a greater number of rows than another of the layers so that the buoyancy of the shell in one orientation is different from that in an opposed orientation.

9. A floatation device comprising a closed outer shell defining therein a hollow interior, the outer shell having a wall formed by molding from a plastics material, and a plurality of separate, sealed air cell members inserted within the hollow interior, the air cell members comprising sealed recycled plastic bottles, each bottle having a generally cylindrical body, a neck at one end of the body and means sealing the neck, each bottle having a wall molded from a plastics material, so that the wall is flexible, wherein spaces between the bottles and between the bottles and the shell are filled with a foam material.

10. A floatation device comprising a closed outer shell defining therein a hollow interior, the outer shell having a wall formed by molding from a plastics material, and a plurality of separate, sealed air cell members inserted within the hollow interior, the air cell members comprising sealed recycled plastic bottles, each bottle having a generally cylindrical body, a neck at one end of the body and means sealing the neck, each bottle having a wall molded from a plastics material so that the wall is flexible, wherein the bottles are arranged end to end so that the neck of one lies adjacent the neck of a next bottle and wherein the shell has a recess therein defining a portion of the inner surface which extends to a position adjacent the necks.

* * * * *